US012011071B1

(12) United States Patent
Solotoff

(10) Patent No.: US 12,011,071 B1
(45) Date of Patent: Jun. 18, 2024

(54) CASE FOR STORING COMPRESSION PANTS AND SHIRT, AND HEAT AND COLD PACKS

(71) Applicant: PREFERRED PRESCRIPTION, INC., Hollywood, FL (US)

(72) Inventor: Brandon Solotoff, Boca Raton, FL (US)

(73) Assignee: Preferred Prescription, INC., Hollywood, FL (US)

( * ) Notice: Subject to any disclaimer, the term of this patent is extended or adjusted under 35 U.S.C. 154(b) by 218 days.

(21) Appl. No.: 17/182,441

(22) Filed: Feb. 23, 2021

Related U.S. Application Data

(60) Provisional application No. 62/984,843, filed on Mar. 4, 2020.

(51) Int. Cl.
*A45C 13/02* (2006.01)
*A45C 13/10* (2006.01)
*F25D 3/08* (2006.01)

(52) U.S. Cl.
CPC ..... *A45C 13/02* (2013.01); *A45C 13/103* (2013.01); *F25D 3/08* (2013.01);
(Continued)

(58) Field of Classification Search
CPC . A45C 13/02; A45C 13/103; A45C 2013/026; A45C 2013/1015; F25D 3/08; F25D 2201/124; F25D 2303/082
See application file for complete search history.

(56) References Cited

U.S. PATENT DOCUMENTS 2,705,063 A * 3/1955 Torrent ..... A45C 13/02 190/111
2,795,258 A * 6/1957 Berry ..... A45C 11/20 190/125

(Continued)

FOREIGN PATENT DOCUMENTS

CN 107898078 A * 4/2018

OTHER PUBLICATIONS

Press Fit Forces Stress Design Calculator, Jun. 18, 2018, available at: www.engineersedge.com/calculators/machine-design/press-fit/press-fit.htm.

(Continued)

*Primary Examiner* — Tri M Mai
(74) *Attorney, Agent, or Firm* — Thomas A. O'Rourke; James Bongiorno; O'Rourke IP Law P.LLC

(57) ABSTRACT

A portable case is particularly configured to store compression garments, and heat and cold packs to maintain respective elevated and reduced temperatures of the heat and cold packs when stored therein. The case includes a first shell coupled to a second shell to pivot between open and closed positions. A zipper releasably secures the two shells together in the closed position. A first thermal insulating material lines the interior of the first shell. A periphery of a second thermal insulating material is fixedly secured to the interior of the first shell a distance away from its full depth forming an insulated compartment. A third thermal insulating material subdivides the compartment into a first insulated sub-compartment for storing heat packs, and a second insulated sub-compartment for simultaneously storing cold packs in a compact arrangement. First and second zippers respectively provide access into the first and second insulated sub-compartment.

12 Claims, 2 Drawing Sheets

(52) U.S. Cl.
CPC ..... *A45C 2013/026* (2013.01); *A45C 2013/1015* (2013.01); *F25D 2201/124* (2013.01); *F25D 2303/082* (2013.01)

(56) References Cited

U.S. PATENT DOCUMENTS 3,031,121 A * 4/1962 Chase ..... B65D 81/3858 383/110
3,637,000 A * 1/1972 Walger ..... A45C 13/00 383/110
4,461,332 A * 7/1984 Parkhurst ..... A45C 3/00 206/823
4,537,313 A 8/1985 Workman
4,703,519 A * 10/1987 Krenzel ..... A45C 3/02 D3/270
5,361,603 A 11/1994 Merritt-Munson
5,474,162 A * 12/1995 Shyr ..... A45C 13/262 190/122
6,102,172 A * 8/2000 Dercole ..... A45C 13/262 190/125
6,213,304 B1 * 4/2001 Juliussen ..... A45C 13/02 224/614
6,427,475 B1 8/2002 DeFelice
8,001,803 B2 8/2011 Kanagaki
9,375,061 B2 * 6/2016 Mosee ..... A45C 7/0063
2002/0023812 A1 * 2/2002 Bernbaum ..... A45C 3/00 190/18 R
2004/0035143 A1 * 2/2004 Mogil ..... A45C 13/02 383/110
2006/0283205 A1 12/2006 Carriere
2008/0245096 A1 * 10/2008 Hanson ..... A45C 11/20 220/592.2
2009/0050429 A1 * 2/2009 Adams, Jr. ..... A45C 13/02 190/109
2011/0031081 A1 * 2/2011 Iceberg ..... A63B 55/60 190/125
2012/0161408 A1 * 6/2012 Sidhu ..... A45C 13/28 280/47.38
2014/0318570 A1 * 10/2014 Petry ..... A45C 5/065 132/314
2018/0192824 A1 * 7/2018 Mogil ..... A45F 3/04
2019/0200719 A1 * 7/2019 Sullivan ..... B65D 33/24
2021/0262755 A1 * 8/2021 Michal ..... B32B 15/18

OTHER PUBLICATIONS

"Three General Types of Fit," available at www.mmto.org/dclark/Reports/Encoder%20Upgrade/fittolerences%20%5BRead-Only%5D.pdf., Jul. 8, 2019.
"Engineering Fit," available at: https://en.wikipedia.org/wiki/Engineering_fit, Jul. 8, 2019.

* cited by examiner

CASE FOR STORING COMPRESSION PANTS AND SHIRT, AND HEAT AND COLD PACKS

CROSS REFERENCES TO RELATED APPLICATIONS

This application claims priority on U.S. Provisional Application Ser. No. 62/984,843, filed on Mar. 4, 2020, the disclosures of which are incorporated herein by reference.

FIELD OF THE INVENTION

The subject technology relates generally to the use of compression garments that incorporate heat packs and/or cold packs therein, and more particularly relates to facilitating convenient storage of the garments and the heat/cold packs to enable repetitive use, particularly when traveling throughout the day while being without access to additional heat/cold packs at elevated/reduced temperatures as needed.

BACKGROUND OF THE INVENTION

Compression garments are clothing items that may be worn to provide support in the form of compressive pressure applied to a particular region or regions of the wearer's body, for either therapeutic reasons, or for enhanced sports performance. Such compression garments are shown, for example, within Applicant's co-pending application Ser. No. 17/020,072, and may include therapeutic shirts and pants, each of which may be configured to receive a plurality of heat/cold packs therein.

In many cases, a person needs to wear such garments throughout the day, for many days, to be effective. At least in such instances where the person is traveling during a day, or may be at work all day long, he or she may typically be without access to facilities to enable heating or cooling of the heat/cold packs for long periods of time, and may also need to change such garments (pants and/or shirt) during the day or during the course of an extended trip.

The herein disclosed storage case facilitates extended use of such garments and the heat/cold packs throughout a day where the person may be traveling, or may be away from home and needs access to such garments, and especially replacement heat/cold packs that are at the proper temperatures.

OBJECTS OF THE INVENTION

It is an object of the invention to provide a storage case configured to store one or more compression garments therein.

It is another object of the invention to provide a storage case that is configured to store heat/cold packs therein in an insulated compartment that prevents rapid heat transfer with respect to the environment.

It is a further object of the invention to provide a storage case configured to store at least one pair of compression pants and compression shirt(s), and corresponding heat and cold packs.

It is yet another object of the invention to provide a storage case that is configured to store both a compression garment, at least one heat pack, and at least one cold pack, with the heat and cold packs being stored in a separate insulated compartments that prevents rapid heat transfer with respect to the environment, and between the other packs.

Further objects and advantages of the invention will become apparent from the following description and claims, and from the accompanying drawings.

It is noted that citing herein of any patents, published patent applications, and non-patent literature is not an admission as to any of those references constituting prior art with respect to the herein disclosed and/or claimed apparatus.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one embodiment, the herein disclosed storage case may broadly include a first shell and a second shell, which first and second shells may be flexibly coupled together at an edge portion of one side of each shell. The remaining edges of each shell may be configured to be releasably joined together using a zipper. The zipper may preferably be a water-resistant or a waterproof zipper. The interior cavity of the first shell may have a thermal insulating aluminum fabric that may be glued to each of its sides and bottom, and may be stitched at the edges, to provide an insulated shell for creating an insulated compartment. The first shell may be used for storing the compression garments (e.g., compression pants, and compression shirt). The second shell may be similarly formed with thermal insulating aluminum fabric that is glued (adhesive bonded) and/or stitched to the sides and bottom, and may be stitched at the edges. In addition, the second shell may have a layer of thermal insulating aluminum fabric sewn to each of the sides, but at a distance away from the bottom of the shell to create an insulated compartment therein. A zipper may be sewn into that layer of thermal insulating aluminum fabric to provide access into the insulated compartment, which may be used for storing of heat and/or cold packs. That insulated compartment may be subdivided by a wall or another piece of thermal insulating fabric to create a first insulated sub-compartment for storing of the heat packs, and a second insulated sub-compartment for simultaneously storing of cold packs, and which may include separate zippers to provide access into each of the two sub-compartments. Because the volume of the compression garments may be larger than the space needed to store the corresponding heat/cold packs, the distance away from the bottom of the shell that the thermal insulating aluminum fabric is sewn to each of the sides may be about one-third of the full depth in one embodiment, or about one-half of the full depth in another embodiment, or about three-quarters of the full depth in yet another embodiment. Other distances for locating the thermal insulating aluminum fabric for creating the wall may alternatively be used.

Each of the shells may be made of any suitable material, including, but not limited to, ethylene vinyl acetate (EVA). Each of the materials used for making the case may be a medical grade material.

A loop for carrying the case may be sewn to one of the shells, and a lanyard or D-ring may be attached to one or both of the sides of one of the shells for releasable attachment of the case to any desired object.

BRIEF DESCRIPTION OF THE DRAWINGS

The description of the various example embodiments is explained in conjunction with appended drawings, in which.

DETAILED DESCRIPTION OF THE INVENTION

Figure 2:
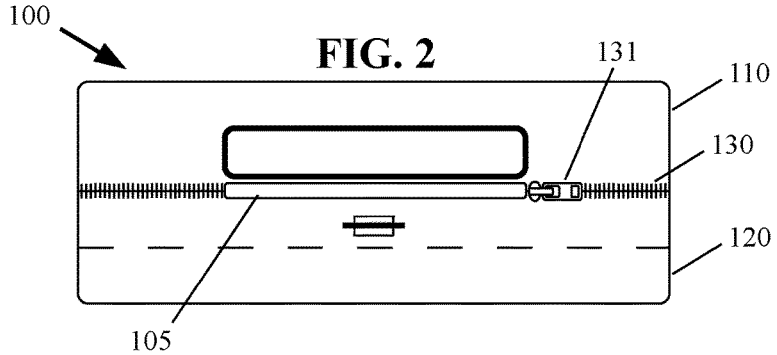
FIG. 2 is a top view of the case of FIG. 1.

As used throughout this specification, the word "may" is used in a permissive sense (i.e., meaning having the potential to), rather than a mandatory sense (i.e., meaning must), as more than one embodiment of the invention may be disclosed herein. Similarly, the words "include", "including", and "includes" mean including but not limited to.

The phrases "at least one", "one or more", and "and/or" may be open-ended expressions that are both conjunctive and disjunctive in operation. For example, each of the expressions "at least one of A, B and C", "one or more of A, B, and C", and "A, B, and/or C" herein means all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference. However, it is noted that the citing of any reference within this disclosure, i.e., any patents, published patent applications, and non-patent literature, is not an admission regarding a determination as to its availability as prior art with respect to the herein disclosed and claimed method/apparatus.

Furthermore, any reference made throughout this specification to "one embodiment" or "an embodiment" means that a particular feature, structure or characteristic described in connection therewith is included in at least that one particular embodiment. Thus, the appearances of the phrases "in one embodiment" or "in an embodiment" in various places throughout this specification are not necessarily all referring to the same embodiment. Therefore, the described features, advantages, and characteristics of any particular aspect of an embodiment disclosed herein may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of a multiplicity of such individual tolerances.

Any use of a friction fit (i.e., an interface fit) between two mating parts described herein indicates that the opening (e.g., a hole) is smaller than the part received therein (e.g., a shaft), which may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit—i.e., loose running, free running, easy running, close running, and sliding (e.g., for a 0.1250 inch shaft diameter the opening may be 0.1285 inches for a close running fit, and may be 0.1360 inches for a free running fit; for a 0.5000 inch diameter shaft the opening may be 0.5156 inches for a close running fit and may be 0.5312 inches for a free running fit). Other clearance amounts are used for other clearance types. See "Engineering Fit" at: https://en.wikipedia.org/wiki/Engineering_fit; and "Three General Types of Fit," available at www.mm-to.org/dclark/Reports/Encoder %20Upgrade/fittolerences %20%5BRead-Only %5D.pdf.

It is further noted that any use herein of relative terms such as "top," "bottom," "upper," "lower," "vertical," and "horizontal" are merely intended to be descriptive for the reader, and may be based on the depiction of those features within the figures for one particular position of the case, and such terms are not intended to limit the orientation with which the disclosed case may be utilized.

Figure 1:
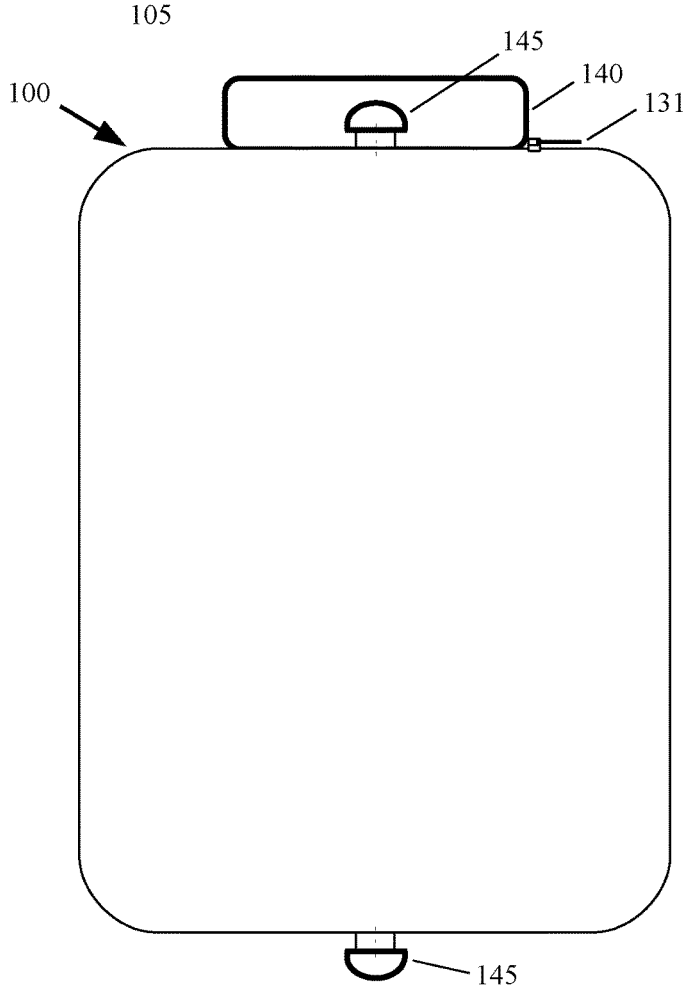
FIG. 1 is a front view of a case for storing compression garments, and for storing the heat/cold packs usable with the compression garments.
Figure 4:
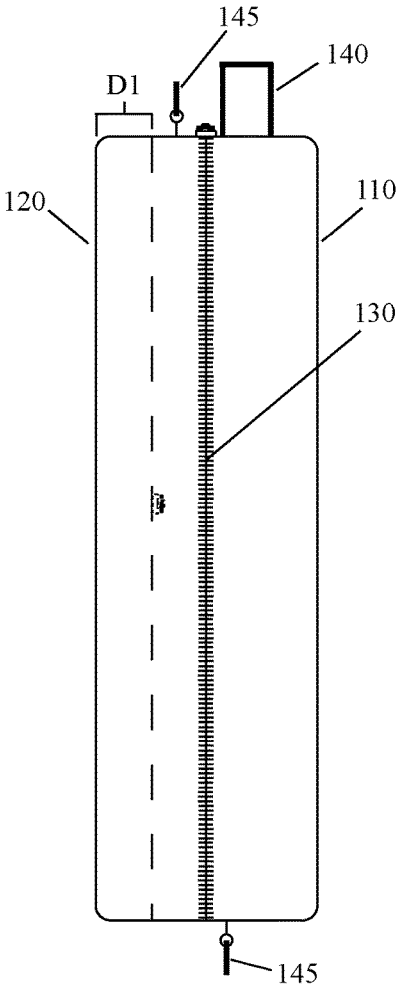
FIG. 4 is a side view through the case of FIG. 1.
Figure 3:
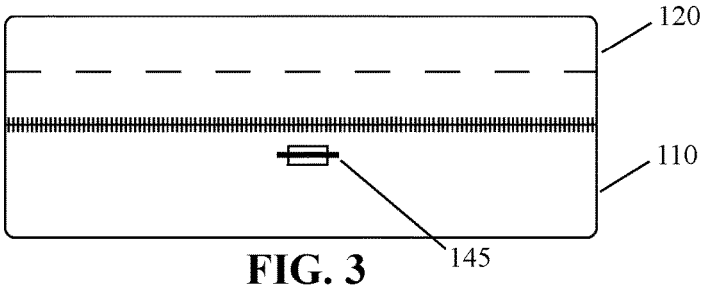
FIG. 3 is a bottom view of the case of FIG. 1.
Figures 5A, 5B, 6:
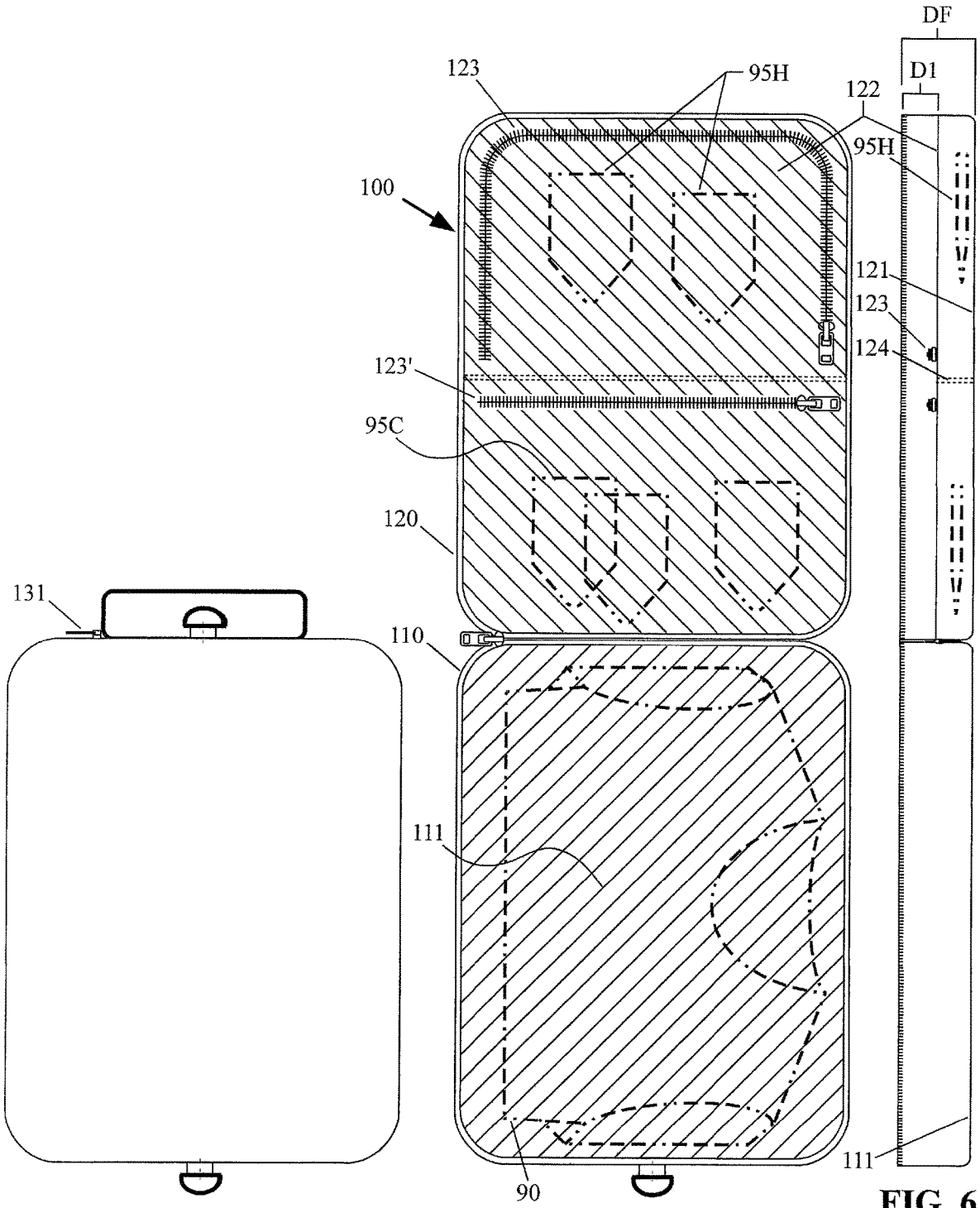
FIG. 5A is the top view of the case of FIG. 1, but shown after the zipper is unzipped.
FIG. 5B is the case of FIG. 5A, but shown after the first shell has been pivoted away from the second shell to expose the interior of each shell.
FIG. 6 is a cross-sectional view through the opened case of FIG. 5B.

In accordance with at least one embodiment, a storage case 100 as shown in FIGS. 1-6 for storing compression garments and heat/cold packs may broadly include: a first shell 110, and a second shell 120. Each of the first shell 110 and second shell 120 may be similarly formed, and may be aimed of any suitable material, including, but not limited to, ethylene vinyl acetate (EVA). Each of the materials used for making the case may be a medical grade material.

The first shell 110 and second shell 120 may be pivotally coupled together in any manner (e.g., using a conventional hinge such as a piano hinge), and may be flexibly coupled together at 105, being at or proximate to an edge portion of one side of each shell. A flexible coupling at 105 may include, but is not limited to, stitching that joins the two shells together; or a living hinge formed by a thin flexible piece of material being integral to the two shells, all of which may be formed as a single piece; or a strip of material that may be secured to an edge of one side of the first shell 110 and to an edge of one side of the second shell 120; etc.

The remainder of the edges of each shell beyond the joining region 105 may be configured to be releasably joined together using a zipper 130, which may have tape and corresponding elements respectively secured to those edges of the first shell 110 and the second shell 120, and which zipper elements may be joined and separated using a slider 131 in a conventional manner. The zipper may be water-resistant or a waterproof zipper. Other structures may be used for releasably joining the two shells together, including, but not limited to: snap members (i.e., mating male and female—see U.S. Pat. No. 3,975,803 to Katayama, and U.S. Pat. No. 1,965,115 to Fenton); and pieces of hook-type fabric material and loop-type fabric material (descriptive names), which are sold under the trademarked name of Velcro®, and which are known to releasably couple to each other.

A loop of material may be secured (e.g., stitched) to one of the shells to serve as a handle 140 for carrying the case 100. Also, a lanyard or D-ring 145 may be attached to one or both of the sides of at least one of the shells for releasable attachment of the case 100 to any desired object.

The interior cavity of the first shell 110 may have a flexible thermal insulating material 111 that may be glued and/or stitched to each of its sides and bottom (i.e., covering each of the interior surfaces of the shell), and may be stitched at the edges, to provide an insulated shell for creating a generally insulated case 100. The flexible thermal insulating fabric 111 may be aluminum and may have a fiberglass fabric backing, and may be, for example, the Z-Flex A-801 Aluminum with Fiberglass Fabric Backing available from NewTex, which is located in Victor, New York.

The first shell 110 may be used for storing the compression garments (e.g., compression pants and a compression shirt 90).

The second shell 120 may be similarly formed to include a flexible thermal insulating material 121 that may be glued and/or stitched to the sides and bottom, and stitched at the edges. In addition, the second shell 120 may have a layer of thermal insulating material 122 secured (glued and/or stitched) to each of the sides at a distance D1 away from the bottom of the shell to create an insulated compartment therein (see FIG. 6). A zipper 123 may be sewn into that layer of thermal insulating material to provide access into the insulated sub-compartment, which may be used for storing of heat and/or cold packs therein.

In another embodiment, that insulated compartment may be subdivided by a wall or another piece of thermal insulating fabric 124 to create a first insulated sub-compartment for storing of the heat packs 9511, and a second insulated sub-compartment for simultaneously storing of cold packs 95C in a separate insulated space, and which may include separate zippers (123 and 123') to provide access into each of the two sub-compartments, because the user may need to first apply heat and then apply cold therapy later in the same day (or vice versa). The zipper may be a short linear zipper configuration, as shown for zipper 123' in FIG. 5B, to minimize the heat exchange that may be permitted as a result of the zipper interrupting the thermal barrier provided by the insulated material. However, to provide greater ease of access into the sub-compartment(s), the zipper may instead be an "L" shape, or the elongated "C" shape shown in FIG. 5B for zipper 123.

Since the volume of the compression garments (pants and shirts) may be substantially larger than the space needed to store the corresponding heat/cold packs, the distance D1 away from the top of the second shell 120 that the thermal insulating aluminum fabric is sewn to each of the sides may preferably be about one-quarter of the full depth $D_F$ of the shell, or alternatively may be about one-third of the full depth $D_F$, or may be about one-half of the full depth $D_F$. Other amounts for the distance D1 for locating the thermal insulating aluminum fabric for creating the wall may alternatively be used, which may depend upon the number of heat/cold packs that are used in the particular compression garments that are to be stored in the first shell 110.

While illustrative implementations of one or more embodiments of the disclosed case are provided hereinabove, those skilled in the art and having the benefit of the present disclosure will appreciate that further embodiments may be implemented with various changes within the scope of the disclosed case. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

I claim:

1. A portable case configured to store at least one compression pant garment and at least one compression shirt garment, and to store corresponding heat packs and cold packs in separate insulated compartments to maintain respective elevated and reduced temperatures of the heat and cold packs when stored therein, said portable case comprising:

a first shell, said first shell comprising: an opening defining an interior surface forming a cavity;

a second shell; said second shell comprising: an opening defining an interior surface forming a cavity configured to store at least a portion of the at least one compression pant garment and the at least one compression shirt garment;

wherein a first portion of a top peripheral edge of said first shell is movably coupled to a first portion of a top peripheral edge of said second shell to move said first shell relative to said second shell between an open position, and a closed position where said opening of said first shell is adjacent to and covers said opening in said second shell;

a first zipper, said first zipper configured to releasably secure a second portion of said top peripheral edge of said first shell to a second portion of said top peripheral edge of said second shell when in said closed position;

a first thermal insulating material, said first thermal insulating material fixedly secured to said interior surface of said first shell;

a second thermal insulating material, a periphery of said second thermal insulating material fixedly secured to said interior surface of said first shell a distance (D1) away from said top peripheral edge of said first shell, wherein said first thermal insulating material is configured to line a bottom portion of said first shell up to said second thermal insulating material, to form an insulated compartment in said first shell;

wherein said distance is at least one-third of a full depth of said first shell, to thereby provide additional storage volume usable by the at least one compression pant garment and at least one compression shirt garment stored in the second shell;

a third thermal insulating material, said third thermal insulating material configured to subdivide said insulated compartment into a first insulated sub-compartment for storing of heat packs, and a second insulated sub-compartment for simultaneous storing of cold packs;

a second zipper;

a third zipper;

wherein said second zipper is positioned in said second thermal insulating material and is configured to provide access into said first insulated sub-compartment; and wherein said third zipper is positioned in said second thermal insulting material and is configured to provide access into said second insulated sub-compartment.

2. The portable case according to claim 1, wherein each of said first shell and said second shell are formed of ethylene vinyl acetate; and wherein each said zipper is a waterproof zipper, to store the compression garments in a waterproof manner.

3. The portable case according to claim 2, wherein said thermal insulating material comprises: aluminum with a fiberglass fabric backing.

4. The portable case according to claim 3, wherein each said zipper is "C" shaped.

5. The portable case according to claim 4, wherein said case is formed of medical grade materials.

6. The portable case according to claim 5, further comprising:

a handle secured to said first shell or said second shell; and a D-ring secured to said first shell or said second shell, for releasable attachment of said case to a desired object.

7. The portable case according to claim 6, further comprising: a conventional hinge, said conventional hinge configured to movably couple said first portion of said first shell to said first portion of said second shell.

8. The portable case according to claim 6, further comprising: a living hinge, said living hinge configured to movably couple said first portion of said first shell to said first portion of said second shell, said living hinge formed by a thin flexible piece of material being integral to each of said first and second shells.

9. The portable case according to claim 6, further comprising: a strip of material, said strip of material configured to movably couple said first portion of said first shell to said first portion of said second shell.

10. The portable case according to claim 6, further comprising: a strip of material, said strip of material configured to movably couple said first portion of said first shell to said first portion of said second shell.

11. The portable case according to claim 6, further comprising: stitching, said stitching configured to movably couple said first portion of said first shell to said first portion of said second shell.

12. A portable case configured to store one compression pant garment and one compression shirt garment, and to store corresponding heat packs and cold packs in separate insulated compartments to maintain respective elevated and reduced temperatures of the heat and cold packs when stored therein, said portable case comprising:

a first shell, said first shell comprising: an opening defining an interior surface forming a cavity;

a second shell; said second shell comprising: an opening defining an interior surface forming a cavity configured to store at least a portion of the at least one compression pant garment and the at least one compression shirt garment;

wherein a first portion of said first shell is movably coupled to a first portion of said second shell to move said first shell relative to said second shell between an open position, and a closed position where said opening of said first shell is adjacent to and covers said opening in said second shell;

a first zipper, said first zipper configured to releasably secure a second portion of said first shell to a second portion of said second shell when in said closed position;

a first thermal insulating material, said first thermal insulating material fixedly secured to said interior surface of said first shell;

a second thermal insulating material, a periphery of said second thermal insulating material fixedly secured to said interior surface of said first shell a distance (D1) away from a top peripheral edge of said first shell, wherein said first thermal insulating material is configured to line a bottom portion of said first shell up to said second thermal insulating material to form an insulated compartment in said first shell;

a third thermal insulating material, said third thermal insulating material configured to subdivide said insulated compartment into a first insulated sub-compartment for storing of heat packs, and a second insulated sub-compartment for simultaneous storing of cold packs;

a second zipper;

a third zipper;

wherein said second zipper is positioned in said second thermal insulating material and is configured to provide access into said first insulated sub-compartment; and wherein said third zipper is positioned in said second thermal insulting material and is configured to provide access into said second insulated sub-compartment; wherein each of said first shell and said second shell are formed of ethylene vinyl acetate;

wherein each said zipper is a waterproof zipper, to store the compression garments in a waterproof manner;

wherein said thermal insulating material consists of aluminum with a fiberglass fabric backing;

wherein said distance is at least one-third of a full depth of said first shell, to thereby provide additional storage volume usable by the at least one compression pant garment and at least one compression shirt garment stored in the second shell;

wherein each said zipper is "C" shaped;

a handle secured to said first shell or said second shell;

a D-ring secured to said first shell or said second shell, for releasable attachment of said case to a desired object; and a living hinge, said living hinge configured to movably couple said first portion of said first shell to said first portion of said second shell, said living hinge formed by a thin flexible piece of material being secured to each of said first and second shells.

* * * * *